United States Patent [19]

Ginsburg et al.

[11] 4,251,332

[45] Feb. 17, 1981

[54] ELECTROLYTIC REDUCTION OF NAPHTHALENE TO ISOTETRALIN

[75] Inventors: David Ginsburg, Haifa, Israel; Wilfried J. W. Mayer, Stuttgart, Fed. Rep. of Germany

[73] Assignee: Miles Laboratories, Inc., Elkhart, Ind.

[21] Appl. No.: 70,137

[22] Filed: Aug. 27, 1979

[51] Int. Cl.[3] ..... C25B 3/04

[52] U.S. Cl. ..... 204/59 R

[58] Field of Search ..... 204/59 R

[56] References Cited

U.S. PATENT DOCUMENTS

| | | | |
|---|---|---|---|
| 3,492,207 | 1/1970 | Yang et al. | 204/59 |
| 3,493,477 | 2/1970 | French et al. | 204/59 |
| 3,684,669 | 8/1972 | Matthews | 204/73 R |
| 3,699,020 | 10/1972 | Connolly et al. | 204/73 R |
| 4,022,673 | 5/1977 | Connolly et al. | 204/73 R |

FOREIGN PATENT DOCUMENTS

| | | |
|---|---|---|
| 50-002508 | 1/1975 | Japan . |
| 52-045707 | 11/1977 | Japan . |

*Primary Examiner*—F. C. Edmundson

*Attorney, Agent, or Firm*—Louis E. Davidson

[57] ABSTRACT

Naphthalene can be reduced to isotetralin by electrolysis of a solution of naphthalene, an electrolyte and an alcohol in a solvent of either ethylenediamine or liquid ammonia.

3 Claims, No Drawings

ELECTROLYTIC REDUCTION OF NAPHTHALENE TO ISOTETRALIN

BACKGROUND AND PRIOR ART

Isotetralin, or 1,4,5,8-tetrahydronaphthalene, is a known material. It is known to be produced by reduction of naphthalene using sodium in liquid ammonia. Electrochemcial reduction of naphthalene to produce 1,4-dihydronaphthalene with minor amounts of tetralin, or 1,2,3,4-tetrahydronaphthalene, is described in U.S. Pat. No. 3,699,020. The solvent-electrolyte system used in this prior process was a mixture of diethylene glycol dimethyl ether, water, tetrabutyl ammonium bromide and ammonia. The electrochemical reduction of benzene to produce 1,4 cyclohexadiene in a solvent-electrolyte system of hexamethylphosphoramide, lithium halide and an alcohol is disclosed in U.S. Pat. No. 3,492,207. When this system was used with napthalene it produced only tetralin. There is no previously known electrolytic reduction process for production of isotetralin.

SUMMARY OF THE INVENTION

In accordance with the present invention a process for the production of isotetralin from naphthalene is provided which comprises the electrolysis of a solution of naphthalene, an electrolyte and an alcohol in a solvent of either ethylenediamine or liquid ammonia.

DESCRIPTION OF THE INVENTION

The naphthalene used as a raw material is well-known and is commercially available from various sources.

The useful solvent is ethylenediamine or liquid ammonia, both of which are well-known and commercially available. The solvent should contain a suitable electrolyte. Lithium chloride and sodium chloride have been found useful, but other electrolytes, such as tetralkyl ammonium halides, known in the art may also be used. The solvent system must also included an alcohol, such as methanol, ethanol, isopropanol and the like, which is soluble in the solvent-electrolyte mixture. The presence of the alcohol prevents formation of tetralin. The relative amounts of the solvent, electrolyte and alcohol are not narrowly critical and can be conveniently determined by one skilled in the art.

The apparatus employed for carrying out the electrolytic process of the present invention is not narrowly critical other than it must be an undivided cell wherein the cathode and anode are in the same chamber. A closed undivided vessel is suitable containing two electrodes. Graphite is a suitable material for both the anode and cathode, but aluminum can also be used for the cathode. The upper portion of the vessel communicates with a condenser for condensing solvent vapors produced during the electrolytic process and returning the condensate to the vessel. Provision is also made for purging the vessel of air and maintaining a non-oxidizing atmosphere within the vessel during the process. The vessel is also conveniently provided with a cooling jacket to maintain desired reaction temperature of the vessel contents during the electrolytic process. The invention is described in further detail in the following examples.

EXAMPLE I

A closed undivided reaction vessel equipped with a cooling jacket, two graphite electrodes, a condenser, a magnetic stirrer and a drying tube containing potassium hydroxide was purged with dry nitrogen. A 100 ml. portion of ethylenediamine which had been distilled over sodium was added to the vessel under a nitrogen blanket. Cooling water at 20° C. was circulated through the cooling jacket and rapid stirring was started. Naphthalene (3.2 ), lithium chloride (1.4 g.) and dry methanol (4.5 ml.) were added. A constant current of 50 mAmp. (13.5 volts) was passed through the cell for 80.4 hr. The current density at the graphite cathode was 9.6 mAmp/cm$^2$ for the electrode area of 5.2 cm$^2$ covered by the liquid phase. during the course of the electrolytic process, the colorless solvent-electrolyte liquid phase turned yellow brown. Gas evolution was observed at both electrodes. The polarity of the electrodes was reversed three times at the start of the electrolysis to overcome an initial resistance.

After completion of the electrolysis, a 100 ml. portion of ice water was added to the vessel and the resulting mixture was continuously extracted with 250 ml. of pentane for 24 hr. The pentane layer was separated, washed with 40 ml. of water, dried with sodium sulfate and the pentane was removed at reduced pressure to produce about 3 g. of a sticky colorless solid. This material was analyzed to contain 87.5 weight percent isotetralin. Pure isotetralin was obtained from this material by recrystallization from methanol or by sublimation.

EXAMPLE 2

The apparatus described in Example 1 was employed except that solid carbon dioxide was used as the coolant in the condenser and the cooling jacket. The cathode was also formed of aluminum foil. The reaction vessel was purged with dry nitrogen before and during addition of the solid carbon dioxide (dry ice) to the condenser and cooling jacket. Liquid ammonia (100 ml.) was condensed into the vessel, and naphthalene (1.28 g.) and sodium chloride (5 g.) were added with rapid stirring, followed by dry methanol (4 ml.). A constant current of 50 mAmp (13.5 volts) was passes through the cell for 42.8 hr. The current density at the aluminum foil cathode was 10 mAMP/cm$^2$ for the electrode area of 5 cm$^2$ covered by the liquid phase. Gas evolution was observed at the cathode during electrolysis.

After completion of the electrolysis, the ammonia was removed by distillation, 100 ml. of ice water were added and 250 ml. pentane were used for continuous extraction for 24 hr. The 1.2 g. of product obtained from the pentane layer was a colorless solid containing 32.5 weight percent isotetralin.

The isotetralin obtained by the process of this invention can be used as a raw material for the chemical synthesis of citric acid.

What is claimed is:

1. A process for the production of isotetralin from naphthalene which comprises the electrolysis of a solution of (a) naphthalene, (b) an electrolyte of lithium chloride or sodium chloride, and (c) an alcohol of methanol, ethanol or isopropanol in a solvent of either ethylene diamine or liquid ammonia.

2. A process according to claim 1 carried out in an undivided cell.

3. A process according to claim 1 wherein the electrolysis is conducted in a non-oxidizing atmosphere.

* * * * *